US009194631B2

(12) United States Patent
Snow et al.

(10) Patent No.: US 9,194,631 B2
(45) Date of Patent: Nov. 24, 2015

(54) HEAT EXCHANGER

(71) Applicant: CalsonicKansei North America, Inc., Farmington Hills, MI (US)

(72) Inventors: James Dean Snow, Novi, MI (US); Wassim Mohsen Hussein, Dearborn Heights, MI (US)

(73) Assignee: CALSONICKANSEI NORTH AMERICA, INC. MI (US)

( * ) Notice: Subject to any disclaimer, the term of this patent is extended or adjusted under 35 U.S.C. 154(b) by 330 days.

(21) Appl. No.: 13/682,462

(22) Filed: Nov. 20, 2012

(65) Prior Publication Data

US 2014/0138070 A1 May 22, 2014

(51) Int. Cl.

| | |
|---|---|
| ***F28F 9/04*** | (2006.01) |
| ***F28F 1/10*** | (2006.01) |
| ***F28F 9/02*** | (2006.01) |
| ***F28D 7/10*** | (2006.01) |
| *F28D 21/00* | (2006.01) |

(52) U.S. Cl.

CPC . *F28F 1/10* (2013.01); *F28D 7/106* (2013.01); *F28F 9/0246* (2013.01); *F28D 2021/0089* (2013.01); *F28F 2275/04* (2013.01); *Y10T 29/49393* (2015.01)

(58) Field of Classification Search

CPC ..... F28F 9/0234; F28F 9/0246; F28F 9/0256

USPC ..... 165/154, 916, 178

See application file for complete search history.

(56) References Cited

U.S. PATENT DOCUMENTS

| | | | | | |
|---|---|---|---|---|---|
| 2,221,934 | A | * | 11/1940 | Ferris | 403/170 |
| 2,752,128 | A | * | 6/1956 | Dedo | 165/155 |
| 2,990,163 | A | * | 6/1961 | Farrell | 165/154 |
| 3,688,372 | A | * | 9/1972 | Frost | 29/890.036 |
| 3,732,921 | A | * | 5/1973 | Hilicki et al. | 165/154 |
| 3,763,930 | A | * | 10/1973 | Frost | 165/154 |
| 3,831,671 | A | * | 8/1974 | Was | 165/154 |
| 3,831,672 | A | * | 8/1974 | Battisti | 165/154 |
| 4,553,586 | A | * | 11/1985 | Lardner | 165/76 |
| 5,228,727 | A | * | 7/1993 | Tokutake et al. | 285/189 |
| 5,758,908 | A | * | 6/1998 | Haasch | 285/192 |
| 6,206,089 | B1 | * | 3/2001 | Uchikawa et al. | 165/109.1 |
| 6,691,771 | B1 | * | 2/2004 | Shinhama et al. | 165/132 |

* cited by examiner

*Primary Examiner* — Allen Flanigan

(74) *Attorney, Agent, or Firm* — Schmeiser, Olsen & Watts LLP

(57) ABSTRACT

A heat exchanger (20) includes an inlet connector (22) having a flat joint surface (23) and an outlet connector (24) having a flat joint surface (25). The heat exchanger (20) also includes a round tube (26). The round tube (26) includes an inlet aperture (28), an outlet aperture (30) and flat surfaces (32, 34) adjacent each of the inlet aperture (28) and the outlet aperture (30). The flat joint surface (23) of the inlet connector (22) is coupled to the flat surface (32) adjacent the inlet aperture (28) and the flat joint surface (25) of the outlet connector (24) is coupled to the flat surface (34) adjacent the outlet connector (24).

17 Claims, 4 Drawing Sheets

HEAT EXCHANGER

TECHNICAL FIELD OF THE INVENTION

This invention relates to the field of heat exchangers. More specifically, the present invention relates to a tube connection design of a flat aluminum surface of a connector to a round aluminum tube of a heat exchanger.

BACKGROUND OF THE INVENTION

A heat exchanger is a device which transfers the heat of one substance to another. Heat exchangers are common in various applications, such as industrial settings, air conditioning, refrigeration, vehicles and the like. Commonly, these heat exchangers are in the form of evaporators, condensers and radiators. Each typically includes passages for a fluid to travel through, wherein the fluid transfers heat to or from the environment through which it is traveling.

Referring to the drawings, FIGS. 1-3 depict a prior heat exchanger 10. FIG. 1 depicts a top view of a heat exchanger 10, FIG. 2 depicts an end view of a heat exchanger 10 and FIG. 3 depicts a bottom view of a connector 12 of a heat exchanger 10. Heat exchanger 10 includes a tube member 16 having fins 17 extending along the length of the tube 16. Further, the heat exchanger 10 includes connector 12, wherein connector 12 has a port 13 and a base 15, wherein base 15 comprises a flat joint surface 14 coupled to base 15. In the prior art connector 12, flat joint surface 14 has a width of represented as D1, wherein the width D1 is less than the diameter of port 13.

Flat joint surface 14 is brazed to tube member 16 in order to functionally couple connector flat joint surface 14 with the round outer surface of tube member 16. In operations, the connection of flat joint surface 14 to tube member 16 of the prior art heat exchanger 10 has limited strength when axial forces are applied to the connector. Failures during operation occur due to structural breakdown between connector 12 and tube 16, such as fatigue stress cracks causing internal fluid leaking to the external surroundings. In other words heat exchanger 10 has limited strength in stress and strain. Thus, there is a need for an improved tube connection design of a flat aluminum surface of a connector to a round aluminum tube of a heat exchanger.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

The present invention entails a heat exchanger used for cooling oil that can be installed within the outlet tank of an automotive radiator. This allows for oil such as transmission fluid to flow through the heat exchanger and be cooled by use of the radiator coolant.

Figure 4:
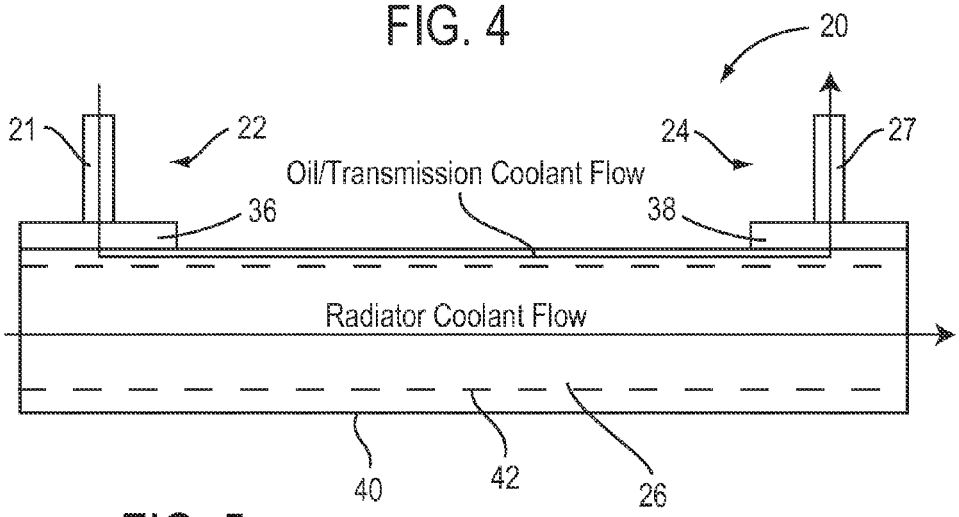
FIG. 4 is a side view of a heat exchanger.
Figure 5:
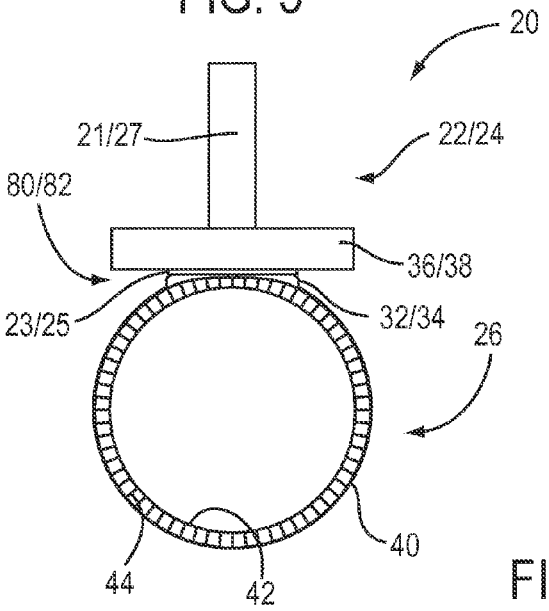
FIG. 5 is an end view of the heat exchanger of FIG. 4.

Referring to FIGS. 4 and 5, FIG. 4 shows a side view of a heat exchanger 20 and FIG. 5 depicts an end view of heat exchanger 20 in accordance with the present invention. Heat exchanger 20 includes an inlet connector 22, an outlet connector 24 and a round tube 26. Inlet connector 22 includes a port 21 and a base 36. Outlet connector 24 includes a port 27 and a base 38. Inlet port 22 and outlet port 24 are coupled to round tube 26.

Round tube 26 includes an outer tube member 40 and a concentric inner tube member 42. Further, round tube 26 includes fins 44 that extend between outer tube member 40 and inner tube member 42 along the length of round tube 26.

Figure 6:
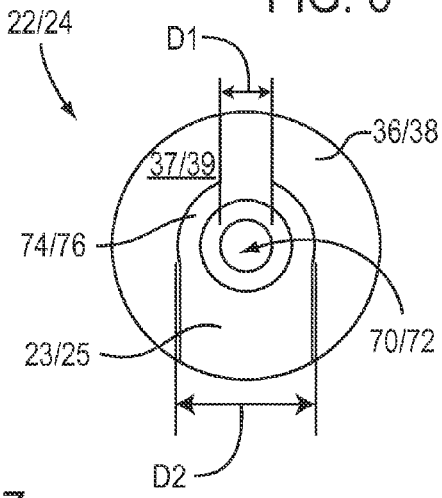
FIG. 6 is a bottom view of an inlet/outlet connector of a heat exchanger.
Figure 7:
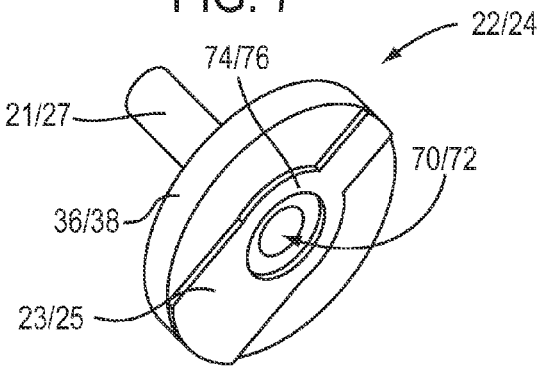
FIG. 7 is a bottom perspective view of an inlet/outlet connector of a heat exchanger.

Referring further to FIGS. 6 and 7, wherein FIG. 6 depicts a bottom view of inlet connector 22 and outlet connector 24 and FIG. 7 depicts a bottom perspective view of inlet connector 22 and outlet connector 24. Inlet connector 22 having base 36 further includes a port aperture 70 having a diameter D1. Port aperture 70 allows fluid to flow through inlet connector 22. Additionally, inlet connector 22 comprises a first flat joint surface 23 that protrudes from a bottom surface 37 of base 36. First flat joint surface 23 extend around port aperture 70, wherein the portion that extends around port aperture denoted by reference character 74 has a diameter D2, which is also referred to herein as flange diameter D2. It will be understood that flange diameter D2 does not extend beyond the diameter of base 36 of inlet connector 22. Additionally, the first flat joint surface 23 defines different widths on diametrically opposed sides of the inlet connector port 70.

Similarly, outlet connector 24 having base 38 further includes a port aperture 72 having a diameter D1. Port aperture 72 allows fluid to flow through outlet connector 24. Additionally, outlet connector 24 comprises a second flat joint surface 25 that protrudes from a bottom surface 39 of base 38. Second flat joint surface 25 extend around port aperture 72, wherein the portion that extends around port aperture 72 denoted by reference character 76 has a diameter D2, which is also referred to herein as flange diameter D2. It will be understood that flange diameter D2 does not extend beyond the diameter of base 38 of outlet connector 24. Additionally the second flat joint surface 25 defines different widths on diametrically opposed sides of the outlet connector port 72.

Figure 8:
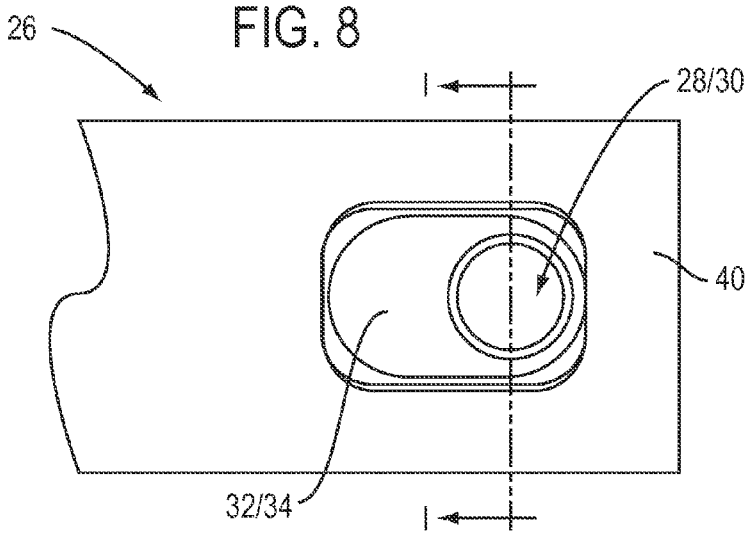
FIG. 8 is a top view of a round tube of the heat exchanger of FIG. 4.
Figure 9:
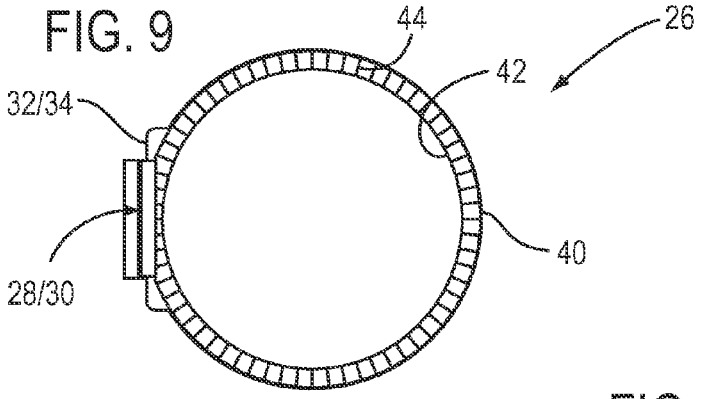
FIG. 9 is a section view taken along line I-I of FIG. 7.

Referring again to the drawings, FIG. 8 depicts a top view of a portion of a round tube 26 and FIG. 9 is a section view of round tube 26 of FIG. 8 taken along line I-I in accordance with the present invention. Round tube 26 includes an inlet aperture 28, an outlet aperture 30, a third flat joint surface 32 adjacent inlet aperture 28 and an fourth flat joint surface 34 adjacent outlet aperture 30. Again, round tube 26 includes an outer tube member 40 and a concentric inner tube member 42. Fins 44 extend between outer tube member 40 and inner tube member 42 along the length of tube member 26. According to particular embodiments, inlet aperture 28 and outlet aperture 30 extend only through outer tube member 40.

In operation, radiator fluid may flow through inner tube member 42 and oil may flow between outer tube member 40 and inner tube member 42 (FIGS. 4 and 5). In this way, heat is transferred from the oil to the radiator fluid through parallel flow heat transfer. Further in operation, fins 44 improve the efficiency of the heat transfer by creating turbulent flow and further creating a greater amount of surface area over which the oil flows, thereby providing greater opportunity for heat transfer along the length of round tube 26.

The width of third flat joint surface 32 adjacent inlet aperture 28 corresponds to the width of first flat joint surface 23 of inlet connector 22. The width of fourth flat joint surface 34 adjacent outlet aperture 30 corresponds to the width of second flat joint surface 25 of outlet connector 24. Accordingly, in some embodiments, the width of third flat joint surface 32 and fourth flat joint surface 34 are each within the range of port diameter D1 and flange diameter D2.

Flat surfaces 32 and 34 of round tube 26 may be formed in various ways. For example and as shown, flat surfaces 32 and 34 may extend partially from the outer surface of outer tube member 40. In other embodiments, flat surfaces 32 and 34 may be formed as part of a portion of outer tube member 40.

Referring again to FIGS. 4 and 5, inlet connector 22 is coupled to tube member 26 such that inlet port 21 is aligned with inlet aperture 28 (best represented in FIGS. 8 and 9) of round tube 26. Further, first flat joint surface 23 aligns with and is in contact with third flat joint surface 32. In this configuration, first flat joint surface 23 is brazed with third flat joint surface 32 to form inlet joint 80. Additionally, outlet connector 24 is coupled to tube member 26 such that outlet port 27 is aligned with outlet aperture 30 (best represented in FIGS. 8 and 9) of round tube 26. Further, second flat joint surface 25 aligns with and is in contact with outlet flat surface 34. In this configuration, second flat joint surface 25 is brazed with fourth flat joint surface 34 to form outlet joint 82. Therefore, the brazing of inlet connector 22 and outlet connector 24 to round tube 26 is performed on flat surfaces.

Figure 1:
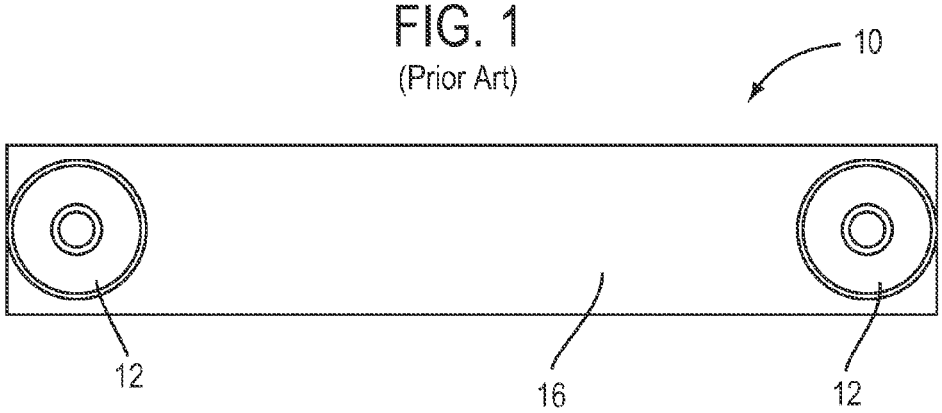
FIG. 1 (Prior Art)
FIG. 1 is a top view of a prior art heat exchanger.
Figure 2:
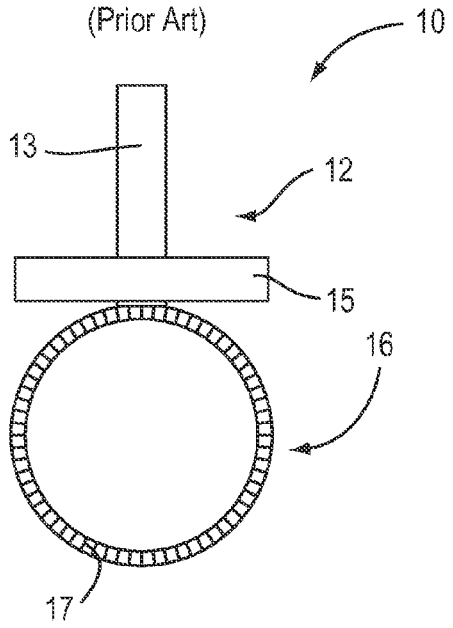
FIG. 2 (Prior Art)
FIG. 2 is an end view of a prior art heat exchanger of FIG. 1.
Figure 3:
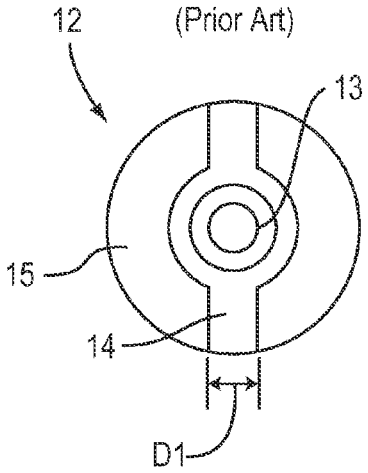
FIG. 3 (Prior Art)
FIG. 3 is a bottom view of a connector of a prior art heat exchanger of FIG. 1.

The prior art inlet and outlet joints suffer from poor strength and fail easily when axial forces are applied to connectors 12. For example, and without limitation, during normal vehicle operation connectors 12 of heat exchanger 10 are subjected to external and internal forces either by thermal expansion due to hot (oil) and cold (radiator coolant) fluids subjected on heat exchanger 10 and also the different coefficient of expansions between the radiator outlet tank resin material and the oil cooler aluminum material. Failures occur due to structural breakdown between connectors 12 and tube 16, such as fatigue stress cracks causing internal fluid leaking to the external surroundings. Accordingly, the prior art joints between the inlet and outlet connectors 12 (FIG. 1) and the tube 16 limits the life of the heat exchanger 10.

The present invention, however, has increased strength and life by increasing surface contact area between the round tube 26 and the inlet and outlet connectors 20 and 22. This is accomplished by the forming of third flat joint surface and fourth flat joint surface 32 and 34. The third and fourth flat joint surfaces 32 and 34 correspond to the first and second flat joint surfaces 23 and 25 respectively and may be coupled together through a brazing process to form inlet joint 80 and outlet joint 82 respectively. Because of the increased area at the inlet joint 80 and outlet joint 82, the brazing reduces the stress and strain localized in problem areas of the prior art after a loading condition occurs.

There are various advantages of the present invention. For example, the process for forming a flat surface design on round tube 26 is relatively inexpensive. Strength of the brazed inlet joint 80 and outlet join 82 is greatly increased and considered to survive the forces applied during normal vehicle operation during the life of the vehicle, which is assumed to be greater than seven years. The process and assembly of round tube-to-connector attachment for brazing is easier to perform. A reduced scrap rate is expected because of a reduction of rejected parts that no longer meet required specifications after the brazing process. That is in prior art brazing processes, the connector tends to rotate during the brazing process, which results in dimensionally brazed joint failures.

Figure 10:
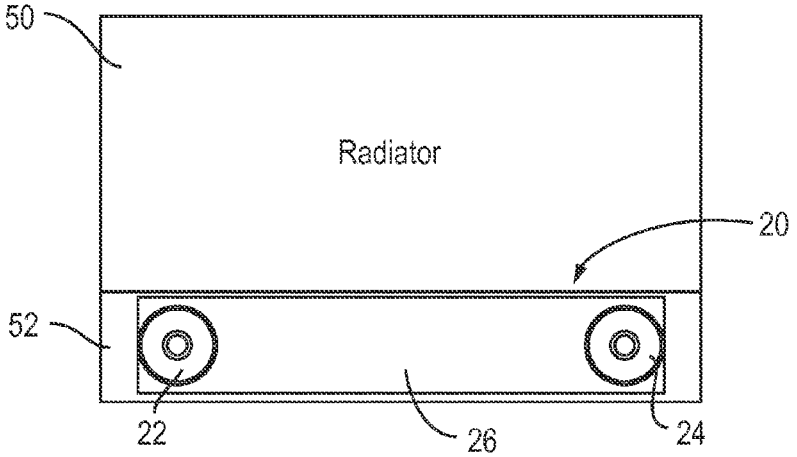
FIG. 10 is a schematic view of a heat exchanger including a radiator.

Referring to the drawings, FIG. 10 depicts a schematic view of heat exchanger 20 in fluid communication and operation with a radiator 50 in accordance with the present invention. Radiator 50 includes a radiator outlet tank 52 and heat exchanger 20 is coupled within radiator outlet tank 52. Heat exchanger 20 includes common components as discussed previously in this disclosure, with main components including an inlet connector 22, an outlet connector 24 and a round tube 26. The radiator fluid flows through round tube 26 through an inner tube member 42 (FIG. 5) of round tube 26. Oil that is external to the radiator 50 flows through inlet connector 22 and along round tube 26 between an outer tube member 40 (FIG. 5) and inner tube member 42 and exits through outlet connector 24. This provides for parallel flow heat transfer along the length of round tube 26.

Figure 11:
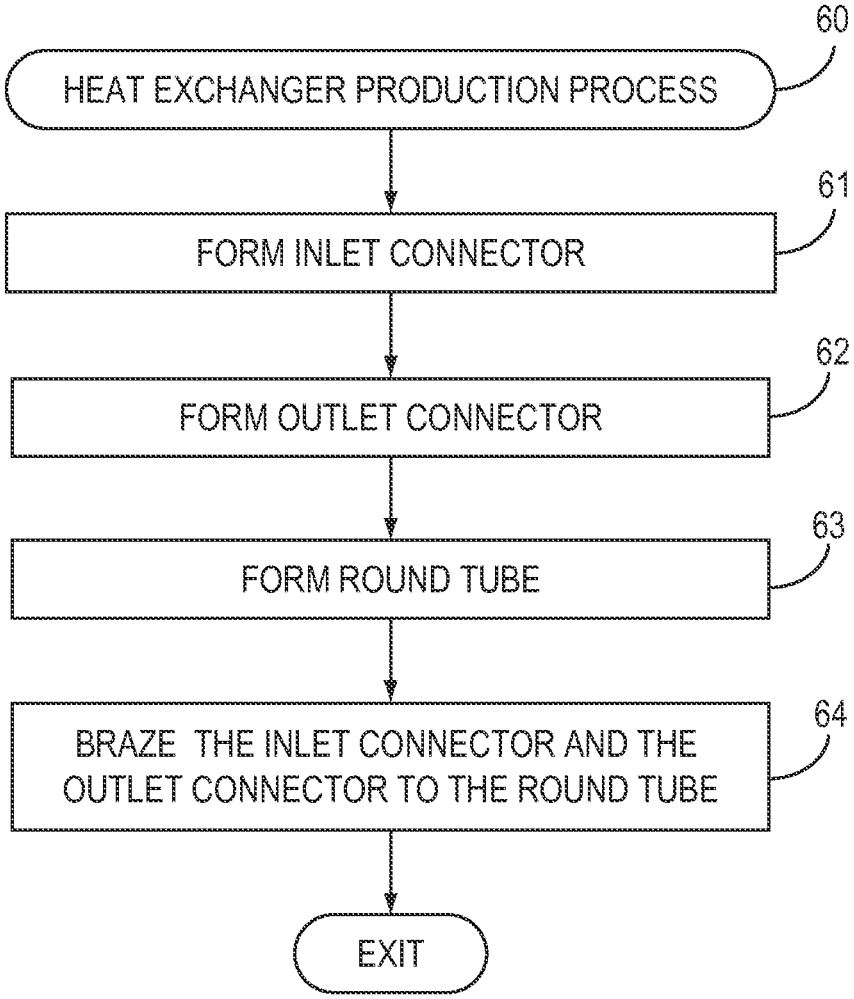
FIG. 11 is a flow chart of a method of forming a heat exchanger.

Embodiments of the present invention include a process 60 of forming a heat exchanger as shown in the flow chart of FIG. 11. The process 60 provides generalized methodology for the operations involved in the manufacture of heat exchanger 20. The operations described in process 60 may take place in a single manufacturing facility in a serial operation. Alternatively, the process 60 may occur in separate facilities and assembled into heat exchanger 20 in an assembly facility. Those skilled in the art will recognize that there are other conventional operations pertaining to the manufacture and assembly of heat exchanger 20. These conventional operations are not described herein for brevity.

Heat exchanger production process 60 begins with an operation 61 to form inlet connector 22. Forming inlet connector 22 may be formed in various ways, such as casting, pressing, machining, and the like. Referring to FIGS. 6 and 7 in connection with operation 61, the forming of inlet connector 22 also includes the forming of port 21 and base 36 with port aperture 70 extending through port 21 and base 36. Further, forming base 36 includes forming first flat joint surface 23.

An operation 62 to form an outlet connector 24 may be performed following operation 61. Forming outlet connector 24 may be formed in various ways, such as casting, pressing, machining, and the like. Referring to FIGS. 6 and 7 in connection with operation 62, the forming of outlet connector 24 also includes the forming of port 27 and base 38 with port aperture 72 extending through port 27 and base 38. Further, forming base 38 includes forming second flat joint surface 25.

Following operation 62 of outlet connector 24 fabrication, an operation 63 may be performed. Referring to FIG. 8, at operation 63, round tube 26 is formed with inlet aperture 28 and outlet aperture 30, third flat joint surface 32 adjacent inlet aperture 28 and fourth flat joint surface 34 adjacent outlet aperture 30.

Following operation 63 of forming a round tube 26, an operation 64 may be performed. At operation 64, first flat joint surface 23 (FIG. 7) of inlet connector 20 (FIG. 7) is brazed to third flat joint surface 32 (FIG. 8) and second flat joint surface 25 (FIG. 7) of outlet connector 22 (FIG. 7) is brazed to fourth flat joint surface 34 (FIG. 8) to form heat exchanger 20 (FIG. 4).

Operation 63 of forming round tube 26 may further comprise forming outer tube member 40 (FIG. 5) and forming a concentric inner tube member 42 (FIG. 5). Additionally, operation 63 further comprises forming a plurality of fins 44 (FIG. 5) and coupling fins 44 between inner tube member 42 and outer tube member 40, wherein fins 44 extend length of round tube 26. Further still, operation 63 comprises forming inlet aperture 28 (FIG. 8) and outlet aperture 30 (FIG. 8) extending through only outer tube member 40. Yet still, operation 63 includes forming third and fourth flat joint surfaces 32 and 34 (FIG. 8) adjacent and offset from each inlet aperture 28 and outlet aperture 30 (FIG. 8) with widths corresponding to respective widths of first and second flat joint surfaces 23 and 25 (FIG. 7) respectively of inlet connector 20 and outlet connector 22 (FIG. 7).

In summary, the present invention teaches of a heat exchanger with having a round tube with flat surfaces to braze flat joint surfaces of inlet and outlet connectors to the flat surfaces. A production method yields the fabrication of a heat exchanger with a round tube having an outer tube member, a concentric inner tube member and fins extending between the two. The production method further enables the brazing of the inlet connector and the outlet connector to the tube in order to provide stronger connector joints to withstand higher pressures and forces. The heat exchanger of the present invention results in greater strength of the brazed joint, greater ease of process and assembly of round tube-to-connector attachment for brazing and reduced scrap rate relative to prior art designs.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A heat exchanger for cooling oil comprising:

an inlet connector having a port and a first flat joint surface, the first flat joint surface protrude from a bottom surface of the inlet connector, wherein the first flat joint surface defines different widths on diametrically opposed sides of the inlet connector port;

an outlet connector having a port and a second flat joint surface, the second flat joint surface protrude from a bottom surface of the outlet connector, wherein the second flat joint surface defines different widths on diametrically opposed sides of the outlet connector port; and a round tube comprising an inlet aperture, an outlet aperture, a third flat joint surfaces adjacent and offset from the inlet aperture, and a fourth flat joint surface adjacent and offset from the outlet aperture, wherein the first flat joint surface is coupled to the third flat joint surface and the second flat joint surface is coupled to the fourth flat joint surface.

2. The heat exchanger as claimed in claim 1, wherein the round tube further comprises an outer tube member and a concentric inner tube member.

3. The heat exchanger as claimed in claim 2, wherein the round tube further comprises a plurality of fins coupled between the inner tube member and the outer tube member, wherein the fins extend the length of the round tube.

4. The heat exchanger as claimed in claim 2, wherein the inlet aperture and the outlet aperture extend through the outer tube member, wherein the round tube is configured to enable a flow of oil between the outer tube member and the inner tube member.

5. The heat exchanger as claimed in claim 1, wherein the widths of the first flat joint surface and the second flat joint surface are each within the range of a port diameter and a flange diameter of the respective inlet connector and outlet connector.

6. The heat exchanger as claimed in claim 5, wherein the width of the third flat joint surface adjacent corresponds to the width of the first flat joint surface and the width of the fourth flat joint surface corresponds to the width of the second flat joint surface.

7. A method of producing a heat exchanger comprising:

forming an inlet connector having a port and a first flat joint surface;

forming the first flat joint surface to protrude from a bottom surface of the inlet connector, wherein the first flat joint surface defines different widths on diametrically opposed sides of the inlet connector port;

forming an outlet connector having a port and a second flat joint surface;

forming the second flat joint surface to protrude from a bottom surface of the outlet connector, wherein the second flat joint surface defines different widths on diametrically opposed sides of the outlet connector port;

forming a round tube comprising an inlet aperture, an outlet aperture, a third flat joint surfaces adjacent and offset from the inlet aperture, and a fourth flat joint surface adjacent and offset from the outlet aperture; and brazing the first flat joint surface to the third flat joint surface and the second flat joint surface to the fourth flat joint surface to form the heat exchanger.

8. The method as claimed in claim 7, wherein forming the round tube further comprises forming an outer tube member and forming a concentric inner tube member.

9. The method as claimed in claim 8, wherein forming the round tube further comprises forming a plurality of fins and coupling the fins between the inner tube member and the outer tube member, wherein the fins extend the length of the round tube.

10. The method as claimed in claim 8, wherein forming the round tube further comprises forming the inlet aperture and the outlet aperture extending through only the outer tube member.

11. The method as claimed in claim 7, wherein forming the round tube comprises forming the third flat joint surface adjacent the inlet aperture and forming the fourth flat joint surface adjacent the outlet aperture with widths corresponding to the respective widths of the first flat joint surface of the inlet connector and the second flat joint surface of the outlet connector.

12. A heat exchanger for cooling oil comprising:

an oil cooling device comprising:

an inlet connector having a port and a first flat joint surface, the first flat joint surface protrude from a bottom surface of the inlet connector, wherein the first flat joint surface defines different widths on diametrically opposed sides of the inlet connector port;

an outlet connector having a port and a second flat joint surface, the second flat joint surface protrude from a bottom surface of the outlet connector, wherein the second flat joint surface defines different widths on diametrically opposed sides of the outlet connector port; and a round tube comprising:

an outer tube member;

a concentric inner tube member;

an inlet aperture formed in the outer tube member;

an outlet aperture formed in the outer tube member;

a third flat joint surface adjacent and offset from the inlet aperture; and a fourth flat joint surface flat surfaces adjacent and offset from the outlet aperture, wherein the first flat joint surface is coupled to the third flat joint surface and the second flat joint surface is coupled to the fourth flat joint surface; and a radiator in fluid communication with the oil cooling device, wherein coolant in the radiator is configured to flow through the inner tube member, oil is configured to flow between the outer tube member and the inner tube member such that the coolant cools the oil.

13. The heat exchanger as claimed in claim 12, wherein the round tube further comprises an outer tube member and a concentric inner tube member.

14. The heat exchanger as claimed in claim 12, wherein the round tube further comprises a plurality of fins coupled between the inner tube member and the outer tube member, wherein the fins extend the length of the round tube.

15. The heat exchanger as claimed in claim 12, wherein the inlet aperture and the outlet aperture extend only through the outer tube member.

16. The heat exchanger as claimed in claim 12, wherein the width of the first flat joint surface and the second flat joint surface are each within the range of a port diameter and a flange diameter of the respective inlet connector and outlet connector.

17. The heat exchanger as claimed in claim 16, wherein the width of the third flat joint surface corresponds to the width of the first flat joint surface adjacent the inlet connector and the width of the fourth flat joint surface corresponds to the width of the second flat joint surface adjacent the outlet connector.

* * * * *